US012025354B2

(12) United States Patent
Wu

(10) Patent No.: US 12,025,354 B2
(45) Date of Patent: Jul. 2, 2024

(54) COOLING PIPE SYSTEM

(71) Applicant: Wuyi University, Jiangmen (CN)

(72) Inventor: Min Wu, Jiangmen (CN)

(73) Assignee: CHINA THREE GORGES UNIVERSITY, Yichang (CN)

( * ) Notice: Subject to any disclaimer, the term of this patent is extended or adjusted under 35 U.S.C. 154(b) by 529 days.

(21) Appl. No.: 17/320,469

(22) Filed: May 14, 2021

(65) Prior Publication Data

US 2022/0034559 A1 Feb. 3, 2022

(30) Foreign Application Priority Data

Jul. 29, 2020 (CN) ..... 202010743882.6

(51) Int. Cl.
*F25B 39/02* (2006.01)

(52) U.S. Cl.
CPC ..... *F25B 39/028* (2013.01)

(58) Field of Classification Search
CPC ..... F25B 39/028; F25B 23/006; F25B 29/02; F25B 37/00; F28D 15/025; F28D 15/0266; F28D 15/0258; F28D 2015/0216; F24F 1/0059; F24F 5/0035
See application file for complete search history.

(56) References Cited

U.S. PATENT DOCUMENTS 5,271,893 A * 12/1993 Newman ..... A61L 2/24 422/11

* cited by examiner

*Primary Examiner* — Harry E Arant

(57) ABSTRACT

A cooling pipe system, including an evaporation pipe slantly arranged, a water inlet pipe, and a water removal assembly. An output end of the water inlet pipe is connected to an input end of the evaporation pipe, the water inlet pipe is connected to a three-way valve for introducing low molecular weight gas into the evaporation pipe. The water removal assembly is located below the evaporation pipe and includes a water sealing cavity, the output end of the evaporation pipe is connected to the water sealing cavity by means of a recovery pipe, the water sealing cavity is connected to a first pipeline extending upwards and communicated with the input end of the evaporation pipe, a lower end of the first pipeline is connected to a molecular sieve for preventing water vapor from passing through, and the water removal assembly is configured for absorbing the water vapor.

10 Claims, 4 Drawing Sheets

COOLING PIPE SYSTEM

CROSS-REFERENCE TO RELATED APPLICATIONS

This application is based on and claims the benefit of priority from Chinese Patent Application No. 2020107438826, filed on 29 Jul. 2020, the entirety of which is incorporated by reference herein.

TECHNICAL FIELD

The present disclosure relates to the technical field of refrigeration devices, and in particular, to a cooling pipe system.

BACKGROUND

Existing manual refrigeration technologies, no matter steam compression refrigeration, steam absorption refrigeration, steam jet refrigeration, adsorption refrigeration, thermoelectric refrigeration, magnetic refrigeration, or acoustic refrigeration, all need to use an electric energy, heat energy, or solar energy auxiliary heat absorber, and the cost is high. However, natural refrigeration technologies, such as air cooling or water cooling, are limited by air temperature or water temperature in natural world, so that the refrigeration temperature thereof is necessarily higher than the air temperature and water temperature, and a refrigeration effect is limited.

SUMMARY

The present disclosure aims at solving at least one of technical problems existing in the prior art. With this regard, the present disclosure provides a cooling pipe system which water for evaporation by heat absorption to implement refrigeration, thereby having low cost. Moreover, the refrigeration temperature of the system is lower than the air temperature and water temperature, thereby achieving an excellent refrigeration effect.

A cooling pipe system according an embodiment of the present disclosure includes an evaporation pipe slantly arranged, an input end of the evaporation pipe being higher than an output end of the evaporation pipe; a water inlet pipe, an output end of the water inlet pipe being connected to the input end of the evaporation pipe, the water inlet pipe being connected to a three-way valve, and the three-way valve being used for introducing low molecular weight gas into the evaporation pipe; and a water removal assembly, located below the evaporation pipe and having a water sealing cavity, the output end of the evaporation pipe being connected to the water sealing cavity by means of a recovery pipe, the water sealing cavity being connected to a first pipeline extending upwards and communicated with the input end of the evaporation pipe, a lower end of the first pipeline being connected to a molecular sieve for preventing water vapor from passing through, and the water removal assembly being configured for absorbing the water vapor.

The technical solution above at least has the following beneficial effects. By extracting air in the evaporation pipe from the three-way valve to form vacuum and filling low molecular weight gas into the evaporation pipe, a partial pressure of the water vapor in the evaporation pipe being zero, and then providing by the water inlet pipe liquid water into the evaporation pipe, the liquid water can absorb heat to be evaporated as the partial pressure of the water vapor in the evaporation pipe is zero, and exchange heat with ambient air thereof by means of the evaporation pipe, so as to implement the refrigeration effect for the ambient air. Since the evaporation pipe is slantly arranged towards the output end, the liquid water flows towards the output end of the evaporation pipe while continuously absorbing heat for evaporation to continue refrigeration for the ambient air. After the water is evaporated, the volume of gas in the evaporation pipe is expanded, and the pressure is increased, driving the gas to move towards the water sealing cavity by means of the recovery pipe. After the gas reaches the water sealing cavity, the water vapor gradually trends from an unsaturated state to a supersaturated state. Redundant water vapor is condensed into liquid water in the water sealing cavity. The low molecular weight gas then moves upwards by means of the molecular sieve and the first pipeline for executing a next refrigeration circulation, implementing continuous refrigeration. In this way, refrigeration can be achieved without using the electric energy, solar energy, heat energy, and the like, which has a low cost. Moreover, the refrigeration temperature is lower than the air temperature and water temperature, thereby having an excellent refrigeration effect.

According to some embodiments of the present disclosure, an inclined angle of the input end of the evaporation pipe towards the output end of the evaporation pipe is 2° to 10°.

According to some embodiments of the present disclosure, a water absorption fiber is disposed in the evaporation pipe.

According to some embodiments of the present disclosure, the evaporation pipe is an S-shaped bent pipe.

According to some embodiments of the present disclosure, the low molecular weight gas is helium or hydrogen.

According to some embodiments of the present disclosure, the evaporation pipe is a copper pipe, a stainless steel pipe, or a thin-walled plastic pipe.

According to some embodiments of the present disclosure, the water removal assembly includes a first water tank, a second water tank, and a second pipeline, the first water tank forms the water sealing cavity, the second water tank has a first upper opening, the second pipeline communicates a lower end of the first water tank with a lower end of the second water tank, and the second pipeline is connected to a first switch valve.

According to some embodiments of the present disclosure, the water removal assembly includes a third water tank and a fourth water tank, the third water tank is placed in the fourth water tank, the fourth water tank is communicated with the outside, the third water tank has a second water sealing cavity, a lower end of the third water tank is provided with a lower opening communicating the third water tank with the fourth water tank, and the lower opening is connected to a second switch valve.

According to some embodiments of the present disclosure, an input end of the water inlet pipe is connected to a third switch valve.

According to some embodiments of the present disclosure, the water inlet pipe is connected to a U-shaped bent pipe located at a lower side of the water inlet pipe.

Additional aspects and advantages of the present disclosure will be partially given in the following description, and some will become apparent from the following description or may be learned from practices of the present disclosure.

BRIEF DESCRIPTION OF THE DRAWINGS

The foregoing and/or additional aspects and advantages of the present disclosure will become apparent and comprehensible from the description of embodiments made with reference to the following accompanying drawings, wherein.

Figure 1:
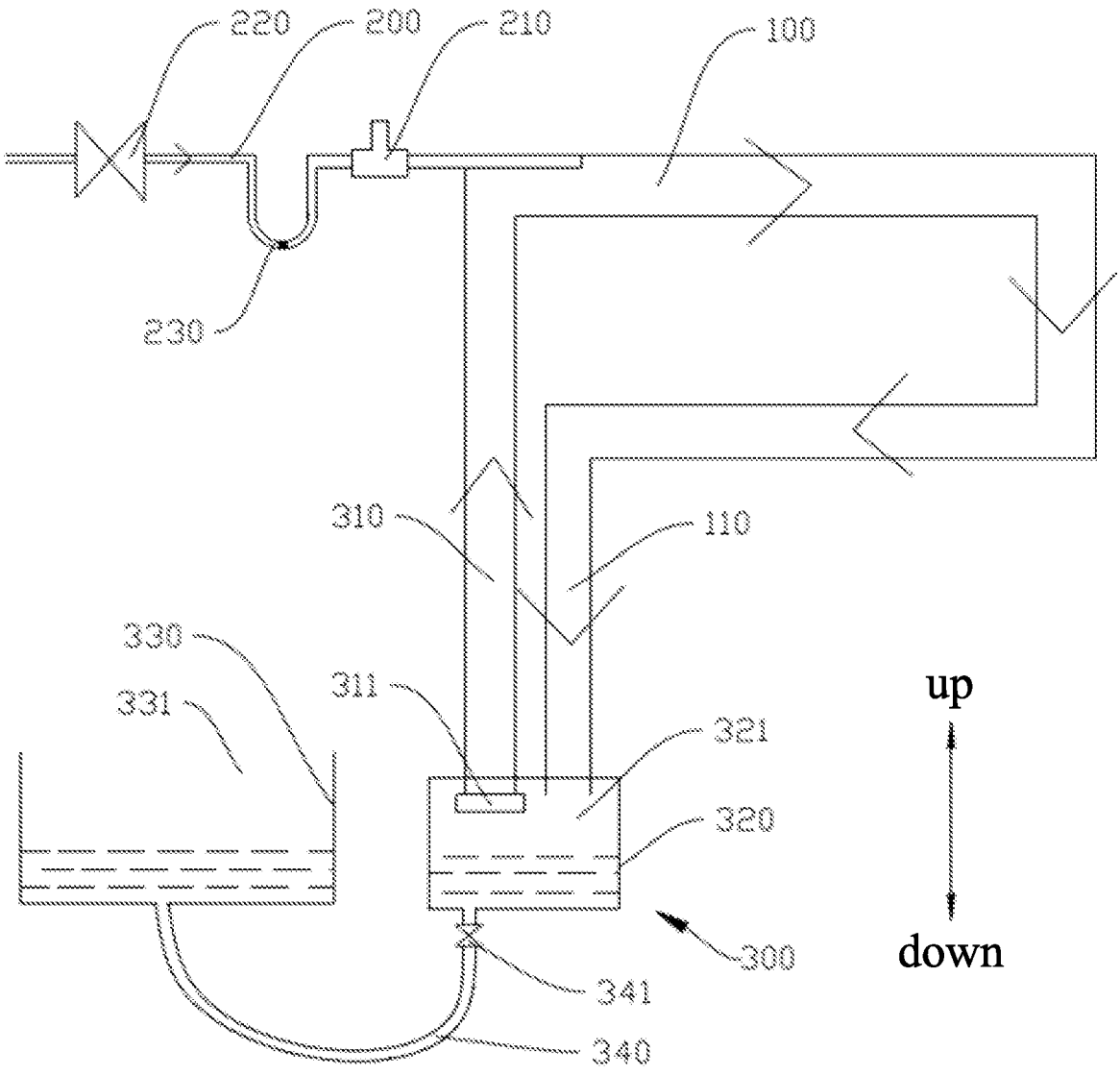
FIG. 1 is a schematic structural diagram of a cooling pipe system according to an embodiment of the present disclosure.

LIST OF REFERENCE NUMERALS evaporation pipe 100
recovery pipe 110
water absorption fiber 120
water inlet pipe 200
three-way valve 210
third switch valve 220
U-shaped bent pipe 230
water removal assembly 300
first pipeline 310
molecular sieve 311
first water tank 320
first water sealing cavity 321
second water tank 330
upper opening 331
second pipeline 340
first switch valve 341
third water tank 350
second water sealing cavity 351
lower opening 352
second switch valve 353
fourth water tank 360

DETAILED DESCRIPTION

This part will describe specific embodiments of the present disclosure in detail. Preferable embodiments of the present disclosure are shown in the accompanying drawings. The accompanying drawings are provided for the purpose of supplementing the written description with graphics, so that each technical feature and the entire technical solution of the present disclosure can be visually and figuratively understood by those having ordinary skill in the art, but they cannot be understood as limitation to the scope of protection of the present disclosure.

In the description of the disclosure, it should be understood that the positional descriptions referred to, for example, the directional or positional relationships indicated by up, down, front, rear, left, right, etc., are based on the directional or positional relationships shown in the drawings, and are only for convenience and simplification of description of the disclosure, but not for indicating or implying that the referred device or element must have a specific direction, be constructed and operated in a specific direction, and thus should not be construed as limiting the disclosure.

In the description of the disclosure, "certain" means one or more, "a plurality of" means two or more, and "greater than", "less than", "more than", etc. are understood as excluding the number itself, "above", "below", "within", etc. are understood as including the number itself. "First", "second", etc., if referred to, are for the purpose of distinguishing technical features only, cannot be understood as indicating or implying a relative importance or implicitly indicating the number of technical features indicated or implicitly indicating the precedence of technical features indicated.

In the description of the disclosure, unless otherwise clearly defined, terms such as "arrange", "mount", "connect" should be understood in a broad sense, and those skilled in the art can reasonably determine the specific meanings of the above terms in the disclosure by combining the specific contents of the technical solutions.

Referring to FIG. 1, an embodiment of the present disclosure provides a cooling pipe system, including an evaporation pipe 100 for absorbing heat through evaporation. The evaporation pipe 100 is slantly arranged, an input end of the evaporation pipe 100 is higher than an output end of the evaporation pipe 100, for facilitating liquid water to automatically flow towards the output end of the evaporation pipe 100. An end of the evaporation pipe 100 is connected to a water inlet pipe 200 for introducing the liquid water into the evaporation pipe 100. An output end of the water inlet pipe 200 is inserted into the evaporation pipe 100. The water inlet pipe 200 is connected to a three-way valve 210 for, on one hand, extracting air in the evaporation pipe 100 to form vacuum, and on the other hand, connecting with an external low molecular weight gas pipeline so as to input the low molecular weight gas, for example, helium or hydrogen, into the evaporation pipe 100, to meet requirements of drifting upwards. The cooling pipe system further includes a water removal assembly 300 for absorbing water vapor. In some embodiment, the water removal assembly 300 includes a first water tank 320, a second water tank 330, and a second pipeline 340 connecting a lower end of the first water tank 320 with a lower end of the second water tank 330. The second pipeline 340 is connected to a first switch valve 341. Both a lower part of the first water tank 320 and a lower part of the second water tank 330 store a small amount of water. A first water sealing cavity 321 is formed at an upper part of the first tank 320. An upper end of the first water sealing cavity 321 is connected to the output end of the evaporation pipe 100 by means of a recovery pipe 110. The upper end of the first water sealing cavity 321 is further connected with a first pipeline 310 extending upwards and communicated with the input end of the evaporation pipe 100. The first pipeline 310 is connected to a molecular sieve 311 which only allows helium or hydrogen to pass through and limits water vapor from passing through. The second water tank 330 is provided with an upper opening 331 communicated with atmosphere to facilitate heat exchange with the atmosphere.

When the cooling pipe system operates, air in the evaporation pipe 100 is first extracted by the three-way valve 210 to form vacuum, then the evaporation pipe 100 is filled with helium or hydrogen. The intensity of pressure of helium or hydrogen is set as one atmospheric pressure, and a partial pressure of the water vapor in the evaporation pipe 100 is zero. The water inlet pipe 200 provides liquid water into the evaporation pipe 100. According to the national water supply code, the pressure of the liquid water is greater than one atmospheric pressure. The liquid water absorbs heat to be evaporated as the partial pressure of the water vapor in the evaporation pipe 100 is zero, and exchanges heat with ambient air thereof by means of the evaporation pipe 100, so as to implement the refrigeration effect for the ambient air. Since the evaporation pipe 100 is slantly arranged, the liquid water flows towards the output end of the evaporation pipe 100 and continuously absorbs heat for evaporation to continue refrigeration for the ambient air. After the water is evaporated, the volume of mixed gases of helium and water vapor (or mixed gases of hydrogen and water vapor) in the evaporation pipe 100 is expanded, and the pressure is increased, driving the mixed gases to move towards the recovery pipe 110 and reach the first water sealing cavity 321. The water vapor in the mixed gases in the first water sealing cavity 321 gradually trends from an unsaturated state to a supersaturated state. Redundant water vapor is condensed into liquid water in the first water sealing cavity 321. The liquid water exchanges heat with the outside by means of the upper opening 331 of the second water tank 330, for volatilization to dissipate heat. The low molecular weight gas in the first water sealing cavity 321 then moves upwards by means of the molecular sieve 311 and the first pipeline 310 and enters the evaporation pipe 100 for executing a next refrigeration circulation, implementing continuous refrigeration. In this way, refrigeration can be achieved without using the electric energy, solar energy, heat energy, and the like, which has a low cost. Moreover, the refrigeration temperature is lower than the air temperature and water temperature, thereby achieving an excellent refrigeration effect.

Figure 2:
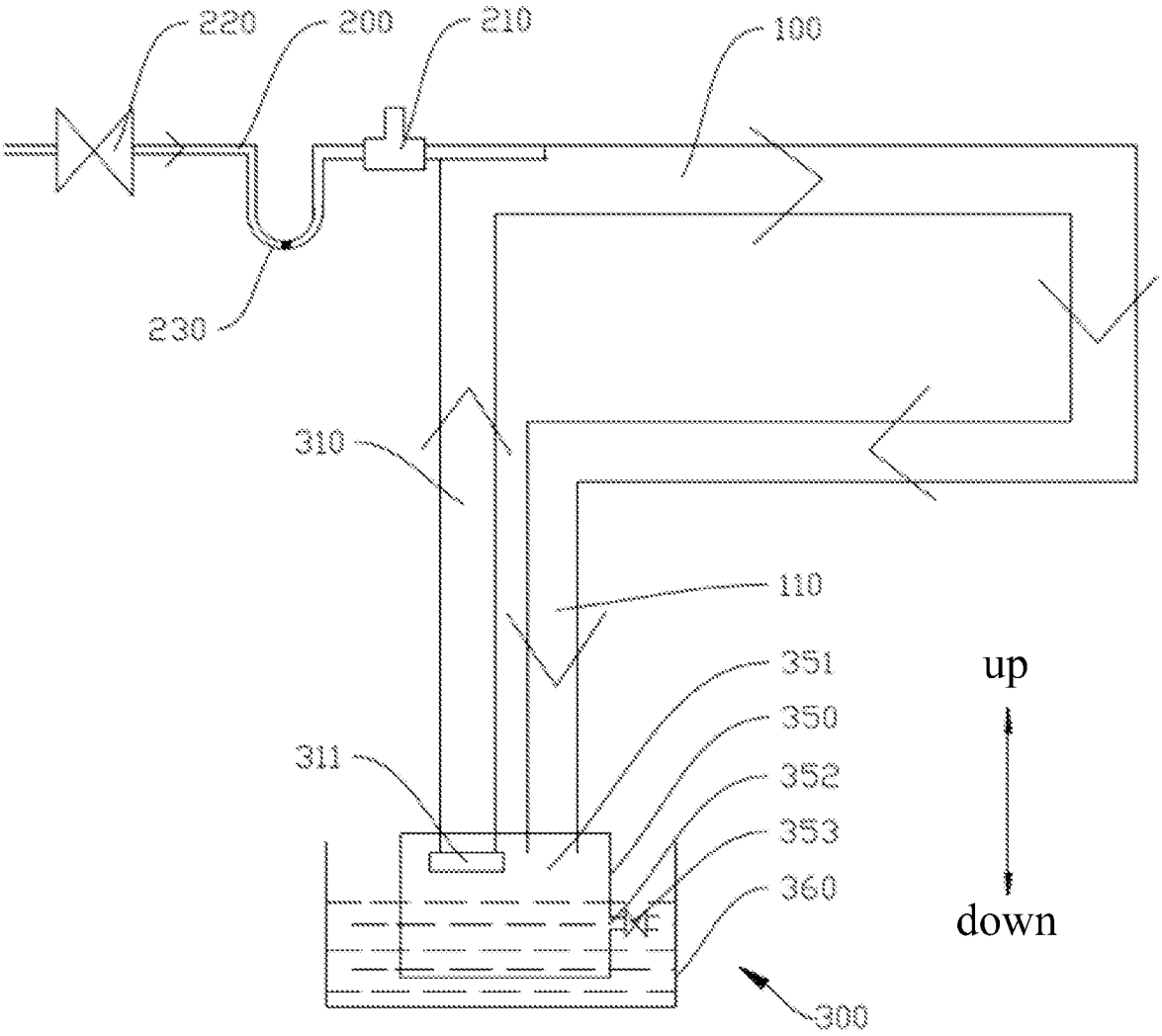
FIG. 2 is a schematic structural diagram of a cooling pipe system according to another embodiment of the present disclosure.

In some other embodiments, referring to FIG. 2, as can be understood, the water removal assembly 300 includes a third water tank 350 and a fourth water tank 360. The third water tank 350 is placed in the fourth water tank 360, while the fourth water tank 360 is communicated with the outside for facilitating heat exchange with the outside. A side wall at a lower end of the third water tank 350 is provided with a lower opening 352 directly communicated with the fourth water tank 360. The lower opening 352 is provided with a second switch valve 353. Both a lower part of the third water tank 350 and a lower part of the fourth water tank 360 store a small amount of liquid water. A second water sealing cavity 351 is formed at an upper part of the third tank 350. An upper end of the second water sealing cavity 351 is connected to the output end of the evaporation pipe 100 by means of the recovery pipe 110. The upper end of the second water sealing cavity 351 is further connected with a first pipeline 310. The water removal assembly 300 in this technical solution has the same principle as that in the embodiment above, and is thus omitted herein for conciseness. The structure of the water removal assembly 300 in this technical solution is more compact, is easier to be mounted, and has a lower cost.

In some embodiments, an inclined angle of the input end of the evaporation pipe 100 towards the output end of the evaporation pipe 100 is 2° to 10°, and preferably, 2°. This inclined angle enables the liquid water to gradually flow towards the output end of the evaporation pipe 100 and slow down the flow of the liquid water to avoid missing evaporation due to rapid flowing of the liquid water. The entire evaporation pipe 100 is provided with the liquid water for heat absorption and evaporation, so that the evaporation pipe 100 fully exchanges heat with the ambient air, to ensure the refrigeration effect.

Figure 3:
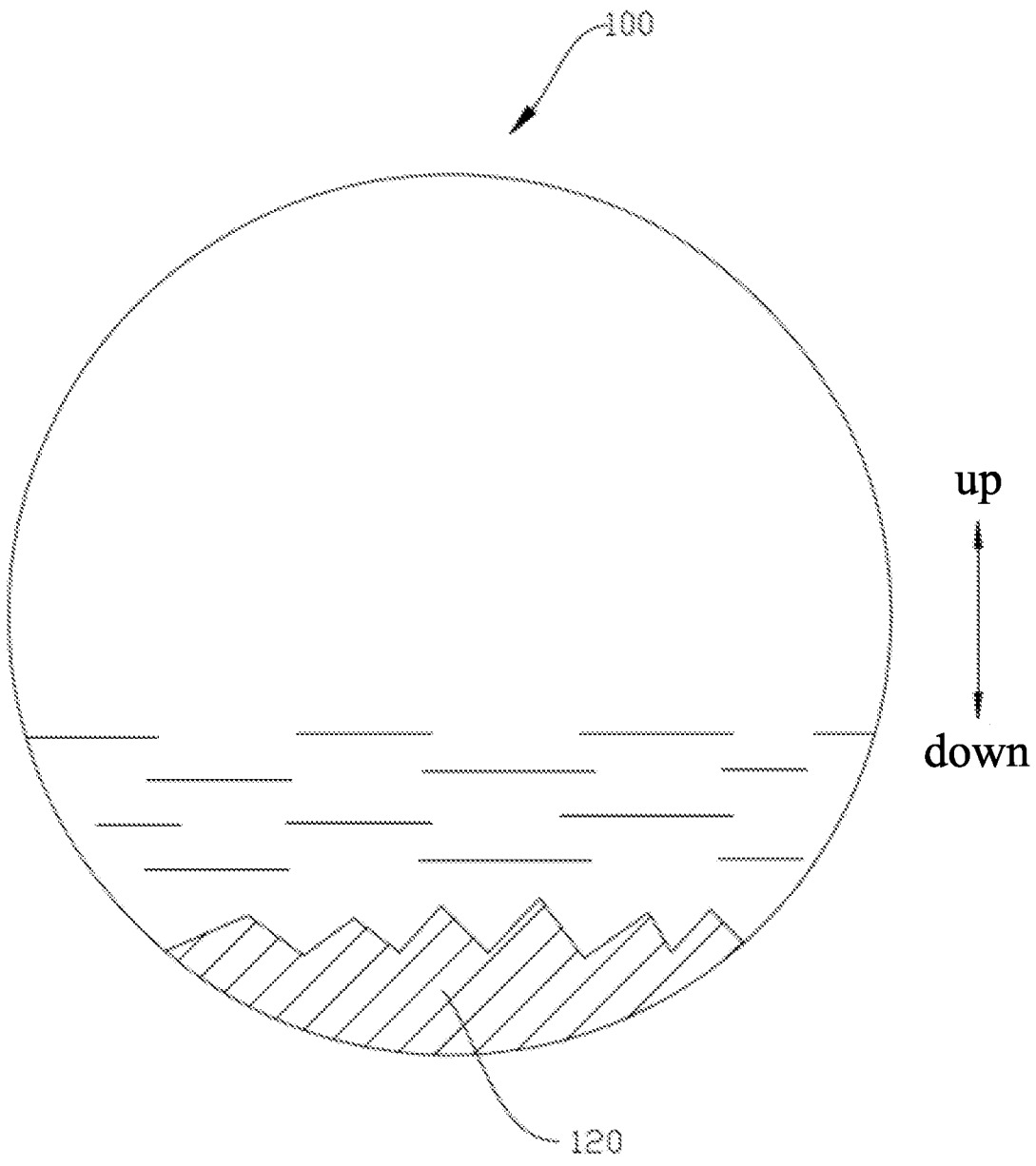
FIG. 3 is a sectional view of an evaporation pipe according to an embodiment of the present disclosure.

Referring to FIG. 3, in some embodiments, a water absorption fiber 120 is disposed in the evaporation pipe 100. As can be seen from the sectional view of the evaporation pipe 100, the evaporation pipe 100 successively has the water absorption fiber 120, liquid water, and helium (or hydrogen) from bottom to top. The water absorption fiber 120 can effectively lower the flow rate of the liquid water so that the liquid water in the evaporation pipe 100 can fully absorb heat to be evaporated and the evaporation pipe 100 can fully exchange heat with the ambient air, to ensure the refrigeration effect.

Figure 4:
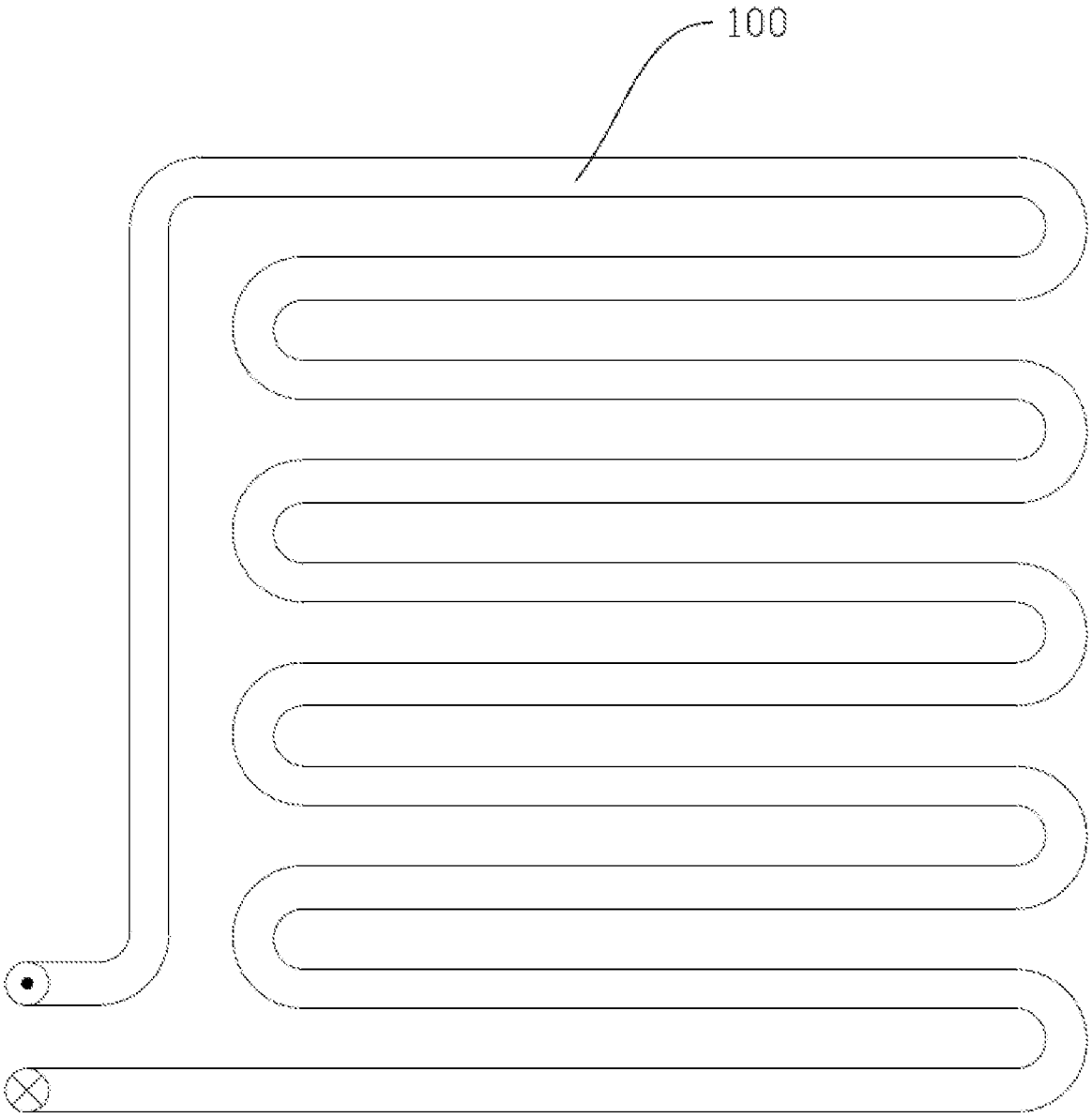
FIG. 4 is a top view of an evaporation pipe according to an embodiment of the present disclosure.

Referring to FIG. 4, in some embodiments, the evaporation pipe 100 is provided as an S-shaped bent pipe, which can increase a contact area between the evaporation pipe 100 and the ambient air, enlarge an area for heat exchange, and accelerate the speed for ambient air refrigeration.

In some embodiments, the evaporation pipe 100 is a copper pipe, a stainless steel pipe, or a thin-walled plastic pipe. The copper pipe, stainless steel pipe, or thin-walled plastic pipe has excellent heat transfer performance, facilitating the heat exchange between the evaporation pipe 100 and the ambient air, and increasing the refrigeration effect.

Referring to FIG. 1, in some embodiments, the input end of the water inlet pipe 200 is connected to the third switch valve 220, facilitating control of water introduction of the evaporation pipe 100. Meanwhile, the third switch valve 220 cooperates with the first switch valve 341, so as to form a sealing ring space in the evaporation pipe 100. The third switch valve 220 and the first switch valve 341 may be turned off before mounting, so as to facilitate extraction of air in the evaporation pipe from the three-way valve 210 to form vacuum and to fill helium or hydrogen into the evaporation pipe 100.

Referring to FIG. 1, in some embodiments, the water inlet pipe 200 is connected to a U-shaped bent pipe 230 at a lower side of the water inlet pipe 200. The U-shaped bent pipe is accumulated with the liquid water to form water sealing, which can prevent helium or hydrogen in the evaporation pipe 100 from escaping.

The embodiments of the present disclosure are explained in detail by combining the accompanying drawings above. However, the present disclosure is not limited to the embodiments above; within the range of knowledge mastered by a person of ordinary skill in the art, various changes may be made under the premise of not departing from purposes of the present disclosure.

What is claimed is:

1. A cooling pipe system, comprising:

an evaporation pipe slantly arranged, an input end of the evaporation pipe being higher than an output end of the evaporation pipe;

a water inlet pipe, an output end of the water inlet pipe being connected to the input end of the evaporation pipe, the water inlet pipe being connected to a three-way valve for introducing gas into the evaporation pipe; and a water removal assembly located below the evaporation pipe and having a water sealing cavity, the output end of the evaporation pipe being connected to the water sealing cavity by means of a recovery pipe, the water sealing cavity being connected to a first pipeline extending upwards and communicated with the input end of the evaporation pipe, a lower end of the first pipeline being connected to a molecular sieve for preventing water vapor from passing through the molecular sieve, and the water removal assembly being configured for absorbing the water vapor.

2. The cooling pipe system of claim 1, wherein an inclined angle of the input end of the evaporation pipe towards the output end of the evaporation pipe is 2° to 10°.

3. The cooling pipe system of claim 1, wherein a water absorption fiber is disposed in the evaporation pipe.

4. The cooling pipe system of claim 1, wherein the evaporation pipe is an S-shaped bent pipe.

5. The cooling pipe system of claim 1, wherein the gas is helium or hydrogen.

6. The cooling pipe system of claim 1, wherein the evaporation pipe is a copper pipe, a stainless-steel pipe, or a plastic pipe.

7. The cooling pipe system of claim 1, wherein the water removal assembly comprises a first water tank, a second water tank, and a second pipeline, the first water tank has a first water sealing cavity, the second water tank has an upper opening, the second pipeline communicates a lower end of the first water tank with a lower end of the second water tank, and the second pipeline is connected to a first switch valve.

8. The cooling pipe system of claim 7, wherein the water removal assembly comprises a third water tank and a fourth water tank, the third water tank is placed in the fourth water tank, the fourth water tank is communicated with the out side, the third water tank has a second water sealing cavity, a lower end of the third water tank is provided with a lower opening communicating the third water tank with the fourth water tank, and the lower opening is connected to a second switch valve.

9. The cooling pipe system of claim 8, wherein an input end of the water inlet pipe is connected to a third switch valve.

10. The cooling pipe system of claim 1, wherein the water inlet pipe is connected to a U-shaped bent pipe at a lower side of the water inlet pipe.

* * * * *